US011255007B2

(12) United States Patent
Okabe et al.

(10) Patent No.: US 11,255,007 B2
(45) Date of Patent: Feb. 22, 2022

(54) AMORPHOUS ALLOY THIN STRIP

(71) Applicant: JFE Steel Corporation, Tokyo (JP)

(72) Inventors: Seiji Okabe, Tokyo (JP); Takeshi Imamura, Tokyo (JP); Katsumi Yamada, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 700 days.

(21) Appl. No.: 16/090,631

(22) PCT Filed: Feb. 7, 2017

(86) PCT No.: PCT/JP2017/004294
§ 371 (c)(1),
(2) Date: Oct. 2, 2018

(87) PCT Pub. No.: WO2017/175469
PCT Pub. Date: Oct. 12, 2017

(65) Prior Publication Data

US 2021/0207252 A1 Jul. 8, 2021

(30) Foreign Application Priority Data

Apr. 4, 2016 (JP) ..... JP2016-074827

(51) Int. Cl.
*C22C 45/02* (2006.01)
*C22C 33/00* (2006.01)
*H01F 1/153* (2006.01)

(52) U.S. Cl.
CPC ..... *C22C 45/02* (2013.01); *C22C 33/003* (2013.01); *C22C 2200/02* (2013.01); *H01F 1/15308* (2013.01)

(58) Field of Classification Search
CPC ... C22C 45/02; C22C 33/003; C22C 2200/02; H01F 1/15308; H01F 1/153; B22D 11/06; B22D 11/0611
See application file for complete search history.

(56) References Cited

U.S. PATENT DOCUMENTS 4,660,622 A 4/1987 Reutler et al.
5,370,749 A 12/1994 Ames et al.
(Continued)

FOREIGN PATENT DOCUMENTS

CN 1270861 A 10/2000
CN 101384745 A 3/2009
(Continued)

OTHER PUBLICATIONS

WO2015016161A1 Thin Amorphous Iron Alloy Strip, Imamura, 2015, Machine translation of description (Year: 2015).*
(Continued)

*Primary Examiner* — John A Hevey
(74) *Attorney, Agent, or Firm* — RatnerPrestia

(57) ABSTRACT

There is provided an amorphous alloy thin strip having a chemical composition represented by a chemical formula: $Fe_xB_ySi_z$ (x: 78-83 at %, y: 8-15 at % and z: 6-13 at %) capable of stably attaining a low iron loss even when shaped into a wound core, wherein a generation density of air pockets on a face contacting with a cooling roll is not more than 8 per 1 $mm^2$ and an arithmetic mean height Sa on portions other than the air pockets is not more than 0.3 μm.

4 Claims, 1 Drawing Sheet

(56) References Cited

U.S. PATENT DOCUMENTS

| | | | | |
|---|---|---|---|---|
| 5,658,397 | A | 8/1997 | Kogiku et al. | |
| 5,833,769 | A * | 11/1998 | Kogiku | H01F 1/15308 148/304 |
| 6,273,967 | B1 | 8/2001 | Matsuki et al. | |
| 6,277,212 | B1 | 8/2001 | Ames et al. | |
| 6,425,960 | B1 | 7/2002 | Yoshizawa et al. | |
| 10,519,534 | B2 * | 12/2019 | Okabe | B22D 11/06 |
| 2002/0043299 | A1 | 4/2002 | Tanaka et al. | |
| 2004/0140016 | A1 | 7/2004 | Sakamoto et al. | |
| 2010/0163136 | A1 | 7/2010 | Ozaki et al. | |
| 2013/0314198 | A1 * | 11/2013 | Yoshizawa | C21D 1/62 336/234 |
| 2015/0050510 | A1 | 2/2015 | Motegi et al. | |
| 2016/0168674 | A1 | 6/2016 | Okabe et al. | |

FOREIGN PATENT DOCUMENTS

| | | | |
|---|---|---|---|
| CN | 102407300 | A | 4/2012 |
| CN | 104245993 | A | 12/2014 |
| CN | 105358727 | A | 2/2016 |
| JP | 54148122 | A | 11/1979 |
| JP | 5594460 | A | 7/1980 |
| JP | 57137451 | A | 8/1982 |
| JP | 58000358 | A | 1/1983 |
| JP | 60228648 | A | 11/1985 |
| JP | 61159247 | A | 7/1986 |
| JP | 06269907 | A | 9/1994 |
| JP | 09268354 | A | 10/1997 |
| JP | 2000054089 | A | 2/2000 |
| JP | 2001059145 | A | 3/2001 |
| JP | 2002205148 | A | 7/2002 |
| KR | 20160020500 | A | 2/2016 |
| WO | 2015016161 | A1 | 2/2015 |
| WO | WO-2015016161 | A1 * | 2/2015 ..... B22D 11/06 |

OTHER PUBLICATIONS

Korean Office Action for Korean Application No. 10-2018-7027222, dated Aug. 14, 2020, with Office Action, 5 pages.

Korean Office Action for Korean Application No. 10-2018-7027222, dated Jan. 28, 2020, with Office Action, 5 pages.

Chinese Office Action for Chinese Application No. 201780018601.7, dated Oct. 8, 2019 with translation, 8 pages.

International Search Report and Written Opinion for International Application No. PCT/JP2017/004294, dated May 9, 2017, 6 pages.

Yoshida et al., "Evaluation Parameters of Surface Texture on Shot-blasted Surfaces", Journal of the Japan Institute of Light Metals, vol. 61, No. 5, (2011) with English abstract, pp. 187-191.

Taiwan Office Action for Taiwan Application No. TW106105098, dated Mar. 6, 2018 with search report, 5 pages.

Japanese Office Action for Japanese Application No. 2016-074827, dated Sep. 12, 2018, 4 pages.

Non Final Office Action for U.S. Appl. No. 14/907,868, dated Oct. 17, 2017, 6 pages.

* cited by examiner

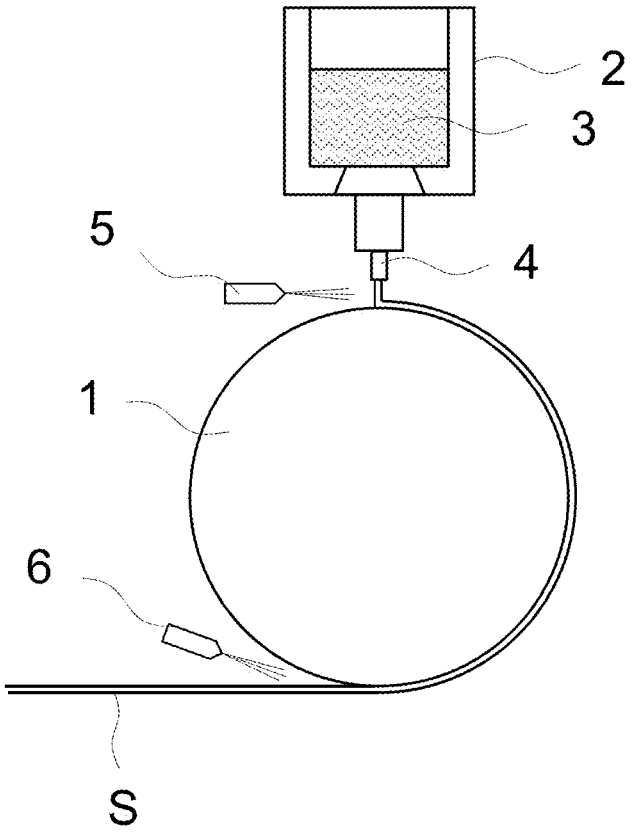
2
3
5
4
1
6
S

AMORPHOUS ALLOY THIN STRIP

CROSS REFERENCE TO RELATED APPLICATIONS

This is the U.S. National Phase application of PCT/JP2017/004294, filed Feb. 7, 2017, which claims priority to Japanese Patent Application No. 2016-074827, filed Apr. 4, 2016, the enclosures of these applications being incorporated herein by reference in their entireties for all purposes.

FIELD OF THE INVENTION

This invention relates to an amorphous alloy thin strip with a low iron loss suitable for use in an iron core or the like for transformers.

BACKGROUND OF THE INVENTION

As an iron core for a distribution transformer or the like is mostly used a wound core made from an amorphous alloy thin strip. As the amorphous alloy thin strip used in the wound core is known an amorphous alloy thin strip having a thickness of several tens μm obtained by injecting a Fe—B—Si series molten alloy based on Fe and added with an element/s such as B, Si and the like onto a cooling roll rotating at a high speed to conduct rapid solidification.

For instance, Patent Literature 1 discloses a Fe—B—Si amorphous alloy containing 80-84 at % of Fe, 12-15 at % of B and 1-8 at % of Si, and Patent Literature 2 discloses an amorphous Fe—B—Si ternary alloy composed of 81-82 at % of Fe, 13-16 at % of B and 3-5 at % of Si, and Patent Literature 3 discloses an amorphous alloy strip having a thickness of not more than 0.003 inch and composed substantially of 77-80 at % of Fe, 12-16 at % of B and 5-10 at % of Si.

The above Fe—B—Si series amorphous alloy thin strips are small in the saturated magnetic flux density though the iron loss is low as compared to a conventional grain-oriented electrical steel sheet, and hence the design magnetic flux density has to be made small, so that it is pointed out that they have problems that the size of the transformer is made large and a large number of copper wires wound onto a coil is required.

Therefore, it is attempted to increase the magnetic flux density of the amorphous alloy thin strip to a certain level by increasing a ratio of Fe ingredient to increase the saturated magnetic flux density. However, the alloy having a high ratio of Fe ingredient has a problem that it is difficult to stably attain the low iron loss property because the amorphous stability is deteriorated. Also, there is a problem that an iron loss value measured in a state that the amorphous alloy thin strip is shaped into a wound core is larger than an iron loss value measured in a state of a raw material or a so-called "building factor" is large. It is because the amorphous alloy thin strip is subjected to an annealing at a relatively low temperature after shaped into the wound core for the purpose of removing strain in the thin strip, during which a part of the strip is crystallized.

As a technique of solving the above problems, Patent Literature 4 discloses a method of rationalizing surface properties of the amorphous alloy thin strip, concretely, decreasing a generation density of air pockets, i.e., the number of air pockets generated per unit area on the surface contacting with the cooling roll.

PATENT LITERATURE

Patent Literature 1: JP-A-S54-148122
Patent Literature 2: JP-A-S55-094460

Patent Literature 3: JP-A-S57-137451
Patent Literature 4: WO2015/016161

SUMMARY OF THE INVENTION

Although the method disclosed in Patent Literature 4 is effective for decreasing the iron loss of the wound core, there are variations in the iron loss, and it is not sufficient for stably decreasing the iron loss, so that further improvement thereof has been desired.

Aspects of the invention are made in consideration of the problems inherent to the above prior arts, and an object thereof is to provide a Fe—B—Si series amorphous alloy thin strip capable of more stably attaining a low iron loss even when shaped into a wound core.

In order to solve the above task, the inventors have made further examinations, focusing on surface properties of the amorphous alloy thin strip. As a result, they have found out that only the decrease of the generation density of air pockets conventionally noticed is insufficient for decreasing the iron loss when the Fe—B—Si series amorphous alloy thin strip is shaped into a wound core, and it is necessary to decrease unevenness generated on other than the air pockets, and aspects of the invention have been accomplished.

That is, one aspect of the invention is an amorphous alloy thin strip having a chemical composition represented by a chemical formula of $Fe_xB_ySi_z$ (x: 78-83 at %, y: 8-15 at % and z: 6-13 at %) wherein a generation density of air pockets in a face contacting with a cooling roll is not more than 8 pockets per 1 $mm^2$ and an arithmetic mean height Sa on portions other than the air pockets is not more than 0.3 μm.

The amorphous alloy thin strip according to aspects of the invention is characterized by containing one or two selected from Cr: 0.2-1 at % and Mn: 0.2-2 at % in addition to the above chemical composition.

Also, the amorphous alloy thin strip according to aspects of the invention is characterized in that one or two selected from C: 0.2-2 at % and P: 0.2-2 at % is included in addition to the above chemical composition.

According to aspects of the invention, it is possible to stably provide an iron-based amorphous alloy thin strip capable of decreasing the iron loss when shaped into a wound core. Therefore, the iron-based amorphous alloy thin strip according to aspects of the invention can be preferably used as a material of a wound core for a transformer.

BRIEF DESCRIPTION OF THE DRAWING

The FIGURE is a schematic view illustrating a single roll type apparatus for manufacturing a rapid cooled thin strip.

DETAILED DESCRIPTION OF EMBODIMENTS OF THE INVENTION

There will be described an experiment building a momentum for developing the invention below.

A molten alloy having a chemical composition containing Fe: 80 at %, B: 10 at %. Si: 9 at % and C: 0.5 at % is injected onto an outer peripheral face of a cooling roll rotating at a high speed in a single-roll type apparatus for manufacturing a rapid cooled thin strip as shown in the FIGURE to conduct rapid solidification and wound into a coil, whereby an iron-based amorphous alloy thin strip having a thickness of 25 μm and a width of 100 mm is manufactured. In this case, a surface roughness of the cooling roll (arithmetic mean height Ra) is variously changed by varying a grit number of an abrasive paper during the polishing of the roll surface, while $CO_2$ concentration contained in an atmosphere of a molten alloy injected portion is variously changed.

The thus obtained amorphous alloy thin strip is wound onto a quarts glass bobbin having a diameter of 200 mmϕ and a width of 105 mm to prepare three toroidal cores of 2 kg per an alloy thin strip manufactured under the same condition. Each of the toroidal cores is subjected to a heat treatment in an argon atmosphere under a condition of 360° C.×1 hr, 380° C.×1 hr or 400° C.×1 hr (annealing in a magnetic field) at a state of applying a magnetic field of 1600 A/m. Thereafter, a primary coil and secondary coil are wound onto the toroidal core and AC-magnetized at 1.3 T and 50 Hz to measure an iron loss $W_{13/50}$.

As a result, a large variation is caused in the iron loss values of the toroidal cores obtained by the above experiment, irrespectively of the same composition, thickness and width. In order to reveal a cause of the variation, the surface of the amorphous alloy thin strip at a side contacting with the cooling roll (hereinafter called as "surface facing to the roll", simply) is examined in detail. As a result, in the thin strip having particularly a high iron loss value, a large number of long recesses in the casting direction (longitudinal direction of the thin strip) are observed on the surface facing to the roll, and the iron loss value is increased particularly in the thin strip having a generation density of the recesses, i.e., the number of the recesses generated per unit area of more than 8 per 1 $mm^2$. The recess is formed by catching atmosphere gas between the molten alloy and the roll surface in the manufacture of the amorphous alloy thin strip and is a so-called "air pocket". The generation density thereof is mainly influenced by the $CO_2$ concentration included in an atmosphere of the molten alloy injected portion. A large number of the recesses are formed when the $CO_2$ concentration is low.

However, even when the $CO_2$ concentration in the atmosphere of the molten alloy injected portion is sufficiently high and the generation density of air pockets is not more than 8 pockets/$mm^2$, the variation of the iron loss value still exists, so that further improvement is required to stably realize the desired iron loss property. In order to determine the cause of the variation of the iron loss value, a relationship between the manufacturing conditions and the variation of the iron loss value is studied, and as a result, it has been confirmed that the iron loss value differs in accordance with the polishing condition of the outer peripheral surface of the cooling roll and there is a tendency that the iron loss is increased as the surface roughness (arithmetic mean height Ra) of the outer peripheral surface of the cooling roll becomes larger.

The inventors have further investigated the surface of the thin strip in detail with an electron microscope capable of measuring a surface roughness of the surface of the amorphous alloy thin strip facing to the roll (hereinafter referred to as "3D-SEM") and confirmed that the size of unevenness on portions other than the air pockets is interrelated to the iron loss value. The reason for using the 3D-SEM is due to the fact that the measurement of the unevenness in the portions other than the air pockets should be conducted so as to avoid the air pockets and therefore it is necessary to use a measuring instrument capable of measuring the unevenness while observing the surface profile, instead of a conventional stylus-type surface roughness meter used in the measurement of two-dimensional surface roughness.

As an indication-representing the size of the unevenness in the portions other than the air pockets is adopted an arithmetic mean height Sa representing an amplitude in a height direction defined by ISO 25178. As the roughness of the roll side surface in the amorphous alloy thin strip obtained by the experiment is measured, it becomes clear that when the arithmetic mean height Sa of the portions other than the air pockets exceeds 0.3 μm, the iron loss of the core is largely increased.

Also, the inventors have manufactured amorphous alloy thin strips by adding other ingredients to the Fe—B—Si ternary alloy and evaluated an iron loss property of a wound core thereof. As a result, it has been found that the magnetic properties of the wound core are further improved by adding an element/s selected from Cr, Mn, C, P, Sn, Sb, Co and Ni and the addition of Cr and/or Mn is particularly effective, and aspects of the invention have been accomplished.

The reason for limiting the chemical composition in the iron-based amorphous alloy according to aspects of the invention will be described below.

At first, the iron-based amorphous alloy according to aspects of the invention has a chemical composition represented by a chemical formula of $Fe_xB_ySi_z$ (wherein x. y and z show at % of each element). It is necessary that each of Fe, B and Si is within the following range.

Fe: 78-83 at % (x: 78-83)

Fe is a base ingredient of the iron-based amorphous alloy according to aspects of the invention. When it is less than 78 at %, the magnetic flux density becomes too low, while when it exceeds 83 at %, the amorphous stability and the iron loss property are deteriorated. Therefore, Fe falls within a range of 78-83 at %. Preferably, it is a range of 80-82 at % (x: 80-82).

B: 8-15 at % (y: 8-15)

B is an element required for making the $Fe_xB_ySi_z$ alloy amorphous. When it is less than 8 at %, it is difficult to stably make the alloy amorphous, while when it exceeds 15 at %, not only the magnetic flux density lowers but also the material cost increases. Therefore, B is a range of 8-15 at %. Preferably, it is a range of 9-13 at % (y: 9-13).

Si: 6-13 at % (z: 6-13)

Si is an element required for decreasing the iron loss and attaining amorphous formation. When it is less than 6 at %, the iron loss increases, while when it exceeds 13 at %, the magnetic flux density largely lowers. Therefore, Si falls within a range of 6-13 at %. Preferably, it falls within a range of 7-11 at % (z: 7-11).

Also, the iron-based amorphous alloy according to aspects of the invention is preferable to contain one or two selected from Cr and Mn having an effect of decreasing the iron loss within the following range as an included number, or with respect to the whole of the alloy, in addition to the above basic ingredients.

Cr: 0.2-1 at %, Mn: 0.2-2 at %

Cr and Mn have an effect of decreasing the iron loss of the wound core and are preferable to be added in an amount of not less than 0.2 at %. However, when they are added excessively, the saturated magnetic flux density lowers, so that the upper limits of Cr and Mn are preferable to be 1 at % and 2 at %, respectively. More preferably, Cr falls within a range of 0.2-0.6 at % and Mn falls within a range of 0.2-0.8 at %. Moreover, the mechanism of decreasing the iron loss by the addition of Cr and Mn is not yet clear sufficiently, but it is guessed that stress sensitivity of the thin strip to the magnetic properties is reduced.

Further, the iron-based amorphous alloy according to aspects of the invention can contain one or two selected from C and P having an effect of stabilizing the amorphous state within the following range as an included number, or with respect to the whole of the alloy, in addition to the above basic ingredients.

C: 0.2-2 at %, P: 0.2-2 at %

C and P have an effect of stabilizing the amorphous state in a composition system having particularly a high Fe ratio. In order to obtain such an effect, each element is preferable to be added in an amount of not less than 0.2 at %. While, when it exceeds 2 at %, the magnetic flux density largely lowers. Therefore, the upper limit of each element is preferable to be 2 at %. More preferably, C falls within a range of 0.2-0.9 at %, and P falls within a range of 0.2-0.9 at %.

Moreover, the iron-based amorphous alloy according to aspects of the invention may contain one or more selected from Sn, Sb, Co and Ni within the following range as an included number, or with respect to the whole of the alloy, in addition to the above basic ingredients and arbitrary addition ingredients.

Sn: 0.2-1 at %, Sb: 0.2-1 at %

Sn and Sb have an effect of decreasing the iron loss of the wound core in the system having particularly a high Fe ratio. In order to obtain such an effect, each element is preferable to be added in an amount of not less than 0.2 at %. While, when it exceeds 1 at %, the iron loss rather increases, so that the upper limit is preferable to be 1 at %. Moreover, the effect of decreasing the iron loss through Sn and Sb is considered due to the fact that the crystallization of the amorphous alloy is suppressed when the core is annealed in the magnetic field.

Co: not more than 2 at %, Ni: not more than 2 at %

Co and Ni have an effect of increasing magnetic permeability, so that they can be added with an upper limit of 2 at %.

Moreover, the remainder other than the above ingredients is inevitable impurities.

The surface properties of the iron-based amorphous alloy thin strip according to aspects of the invention will be described below.

In the iron-based amorphous alloy thin strip according to aspects of the invention, the generation density of air pockets on the surface contacting with the cooling roll (roll side surface) is necessary to be not more than 8 per 1 $mm^2$. The air pocket blocks heat transfer to the cooling roll and inhibits the amorphous formation, leading to partial crystallization. Also, domain wall displacement is suppressed by a pinning effect to increase the iron loss. Therefore, the number of the air pockets is preferable to be small as much as possible and is most desirable to be 0. Moreover, the air pocket is defined as a recess having a width and/or a length of not less than 0.5 mm (width and/or length as an original size are not less than 25 μm) in a photograph of the alloy thin strip shot on the surface of the cooling roll over all round of 10 mm at a magnification of 20 times.

In the iron-based amorphous alloy thin strip according to aspects of the invention, the surface properties on portions other than the air pockets is also important. It is because when the amorphous alloy thin strip is used as an iron core for a transformer, the magnetization is promoted by domain wall displacement of the thin strip, but even when the unevenness is smaller than the air pocket, it acts as a factor of blocking the domain wall displacement. Thus, it is also necessary to suppress a size of the unevenness on portions other than the air pockets, or an amplitude in the height direction.

Concretely, an arithmetic mean height Sa defined by ISO 25178 is adopted as an indication representing the size of the unevenness on the portions other than the air pockets. The value of Sa measured with the 3D-SEM is necessary to be not more than 0.3 μm. Preferably, it is not more than 0.2 μm.

The method of manufacturing the iron-based amorphous alloy thin strip according to aspects of the invention will be described below.

The iron-based amorphous alloy thin strip according to aspects of the invention is obtained by rapid cooling and solidifying a molten alloy adjusted to the above chemical composition. As the rapid cooling method can be used an usual thin strip manufacturing method wherein a molten alloy is injected onto an outer peripheral surface of a cooling roll made from a copper alloy rotating at a high speed through a slit-shaped nozzle to conduct rapid solidification for amorphous formation as shown in the FIGURE.

In the use of the above thin strip manufacturing method, it is important in accordance with aspects of the invention that the generation density of air pockets on the surface of the amorphous alloy thin strip facing to the roll is decreased to not more than 8 pockets/$mm^2$. To this end, it is preferable that a portion of the surface of the cooling roll injected with the molten iron has a $CO_2$ rich atmosphere containing not less than 70 vol % of $CO_2$ (the remainder is argon, nitrogen or residual air) or an exhaust gas ($CO+CO_2$) atmosphere obtained by combusting CO. In order to obtain such an atmosphere, it is effective to inject $CO_2$ gas or CO combustion gas to a rear face of the nozzle for injecting the molten alloy (at an upstream side of the rotating roll). The reason why the occurrence of the air pockets is suppressed by the $CO_2$ rich atmosphere or the CO combustion gas atmosphere is due to the fact that oscillation of the molten alloy pool on the roll (puddle) is prevented. Although this reason is not clear, it is considered that the $CO_2$ gas or CO combustion gas acts on the oxidation state of the molten alloy surface (uniformity, wettability and the like) for the prevention of oscillation. In this regard, a gas other than the $CO_2$ gas or CO combustion gas may be used as far as the number of the air pockets can be decreased.

As the method of decreasing the generation density of air pockets may be adopted a method of injecting the molten alloy in an atmosphere holding vacuum as in the manufacture of a narrow-width alloy thin strip having a width of not more than 50 mm. However, when an alloy thin strip having a width of not less than 100 mm is manufactured like an alloy thin strip used in a distribution transformer to be targeted in accordance with aspects of the invention, it is required to use a large-scale vacuum apparatus.

In order to decrease the generation density of air pockets on the surface of the amorphous alloy thin strip, it is also effective to blow an atmosphere gas heated to about 800° C. as a hot air onto the surface of the cooling roll during the rapid solidification.

When a foreign substance is adhered to or contacted with the surface of the cooling roll, a streaky flaw in the circumferential direction is apt to be caused on the surface of the cooling roll. Such a flaw causes a long air pocket. In the apparatus for manufacturing the amorphous alloy thin strip, therefore, it is desirable to adopt a countermeasure such as removal of surrounding dusts, online grinding of the roll surface or the like.

In order that the size of the unevenness on the surface of the iron-based amorphous alloy thin strip according to aspects of the invention facing to the roll at the portions other than the air pockets (arithmetic mean amplitude Sa in the height direction) is reduced to not more than 0.3 μm, the surface roughness of the outer peripheral face of the cooling roll for rapid cooling and solidifying the molten alloy is preferable to be made smaller. Concretely, it is preferably not more than 5 μm, more preferably not more than 1 μm as an arithmetic mean height Ra.

Further, the material of the cooling roll for rapid cooling and solidifying the molten alloy acts on the unevenness in the portions other than the air pockets. A copper alloy having a good heat conductivity is usually used in the cooling roll. However, when Si is contained in the copper alloy, the size of the unevenness in the portions other than the air pockets can be further reduced. Although the reason is not yet clear sufficiently, it is considered that the wettability to the cooling roll is improved because the iron-based amorphous alloy according to aspects of the invention contains Si.

As the copper alloy containing Si is included a Cu—Ni—Si series alloy called as a Corson alloy containing, for example, about 0.4-0.9 mass % of Si. This copper alloy can be preferably used as a substitute alloy for beryllium copper, which is toxic but frequently used in the cooling roll owing to the high strength thereof.

Example 1

An amorphous alloy thin strip having a thickness of 25 μm and a width of 100 mm is prepared by injecting a molten iron alloy having a chemical composition of Fe: 81 at %, B: 11 at % and Si: 8 at % represented by a chemical formula of $Fe_{81}B_{11}Si_8$ onto an outer peripheral face of a cooling roll rotating at a high speed with a single-roll type rapid cooled thin strip manufacturing apparatus shown in the FIGURE and then wound into a coil. Moreover, a copper alloy having a various Si content as shown in Table 1 is used in the cooling roll of the rapid cooled thin strip manufacturing apparatus. Also, the surface roughness (arithmetic mean height Ra) on the surface of the cooling roll is variously changed by varying a grit number of an abrasive paper during the polishing as shown in Table 1. Further, an atmosphere in a portion injected with the molten alloy is variously changed as shown in Table 1.

The thus obtained amorphous alloy thin strip is wound onto a quartz glass bobbin having a diameter of 200 mmϕ and a width of 105 mm to prepare three toroidal cores of 2 kg per the alloy thin strip manufactured under the same conditions. Each of the toroidal cores is subjected to a heat treatment under a condition of 360° C.×1 hr, 380° C.×1 hr or 400° C.×1 hr at a state of applying a magnetic field of 1600 A/m (annealing in magnetic field). Thereafter, a primary coil and secondary coil are wound onto the toroidal core and magnetized by an alternating current at 1.3 T and 50 Hz to measure an iron loss $W_{13/50}$. A lowest iron loss value in the toroidal cores annealed in the magnetic field under three conditions is adopted as a typical iron loss value in such manufacturing condition.

Also, the generation density of air pockets on the surface of the amorphous alloy thin strip facing to the roll is measured from microscope photographs shot over 10 $mm^2$ at a magnification of 20 times in 5 places with an interval of 20 mm in the widthwise direction. An average of the measured values is used as a generation density of air pockets under the manufacturing condition.

Further, 5 places of the surface facing to the roll in the widthwise direction are observed with a 3D-SEM at a magnification of 2000 times in the same manner as the measurement of the generation density of air pockets to measure a size of unevenness on portions other than the air pockets (arithmetic mean height Sa), and an average of the measured values is used as an arithmetic mean height Sa under the manufacturing condition.

The above measured results are also shown in Table 1. As seen from this table, the amorphous alloy thin strips manufactured under the conditions adapted according to aspects of the invention have good properties such as a generation density of air pockets of not more than 8 pockets/$mm^2$, an arithmetic mean height Sa on portions other than air pockets of not more than 0.30 μm and an iron loss $W_{13/50}$ as a wound core of not more than 0.30 W/kg.

TABLE 1

| No. | Ra on cooling roll surface (μm) | Atmosphere gas of molten alloy injected portion (remainder: Air) | Si content in cooling roll (mass %) | Generation density of air pockets (number/$mm^2$) | Sa on portions other than air pockets (μm) | Iron loss of core $W_{13/50}$ (W/kg) | Remarks |
|---|---|---|---|---|---|---|---|
| 1 | 0.1 | $CO_2$: 100 vol % | 0.6 | 1 | 0.10 | 0.16 | Invention Example |
| 2 | 0.1 | CO combustion gas | 0.3 | 1 | 0.12 | 0.18 | Invention Example |
| 3 | 0.1 | $CO_2$: 70 vol % | 0.7 | 3 | 0.13 | 0.18 | Invention Example |
| 4 | 0.5 | $CO_2$: 100 vol % | 0.6 | 2 | 0.20 | 0.22 | Invention Example |
| 5 | 1.0 | $CO_2$: 100 vol % | 0.2 | 2 | 0.25 | 0.22 | Invention Example |
| 6 | 5.0 | $CO_2$: 100 vol % | 0.9 | 2 | 0.30 | 0.20 | Invention Example |
| 7 | 0.1 | $CO_2$: 60 vol % | 0.6 | 10 | 0.22 | 0.34 | Comparative Example |
| 8 | 6.0 | $CO_2$: 100 vol % | 0.6 | 2 | 0.51 | 0.31 | Comparative Example |

TABLE 1-continued

| No. | Ra on cooling roll surface (μm) | Atmosphere gas of molten alloy injected portion (remainder: Air) | Si content in cooling roll (mass %) | Generation density of air pockets (number/mm$^2$) | Sa on portions other than air pockets (μm) | Iron loss of core $W_{13/50}$ (W/kg) | Remarks |
|---|---|---|---|---|---|---|---|
| 9 | 6.0 | $CO_2$: 50 vol % | 0.6 | 15 | 0.93 | 0.40 | Comparative Example |
| 10 | 0.1 | $CO_2$: 70 vol % | <0.1 | 3 | 0.46 | 0.32 | Comparative Example |
| 11 | 1.0 | $CO_2$: 100 vol % | <0.1 | 2 | 0.51 | 0.36 | Comparative Example |

Example 2

An amorphous alloy thin strip having a thickness of 25 μm and a width of 100 mm is prepared from a Fe—B—Si series molten alloy having a chemical composition shown in Table 2 with the same rapid cooled thin strip manufacturing apparatus as in Example 1 and wound into a coil. Moreover, a copper alloy containing 0.6 mass % of Si is used in the cooling roll of the rapid cooled thin strip manufacturing apparatus and a surface roughness Ra of an outer peripheral surface of the cooling roll is adjusted to 0.5 μm. An atmosphere of a portion injected with the molten alloy is $CO_2$: 100 vol %.

Moreover, as surface properties of the surface of the thus obtained amorphous alloy thin strip facing to the roll are measured, each generation density of air pockets is 1 pocket/mm$^2$, and the size of unevenness on portions other than the air pockets (arithmetic mean height Sa) falls within a range of 0.15-0.21 μm.

Then, 3 toroidal cores per each alloy composition are prepared from the above amorphous alloy thin strip and subjected to annealing in a magnetic field under the three conditions to measure an iron loss $W_{13/50}$. A lowest iron loss under three annealing conditions is used as a typical iron loss value of such an alloy.

Further, a test specimen having a width of 100 mm and a length of 280 mm is taken from the above amorphous alloy thin strip and subjected to annealing in the magnetic field under a condition that the iron loss of the toroidal core becomes minimum in a nitrogen atmosphere and at a state of applying a magnetic field of 1600 A/m in the longitudinal direction, and thereafter a magnetic flux density $B_8$ (magnetic flux density at a magnetization force of 800 A/m) is measured with a veneer magnetic measuring apparatus.

The measured results are also shown in Table 2. As seen from this table, the alloy thin strips having a chemical composition adapted according to aspects of the invention are high in the magnetic flux density and low in the iron loss as a core. Among them, alloys containing one or two of Cr and Mn as an alloying ingredient have an excellent iron loss property.

TABLE 2

| No. | Alloy ingredients (at %) | Iron loss as a core $W_{13/50}$ (W/kg) | Magnetic flux density $B_8$ (T) | Remarks |
|---|---|---|---|---|
| 1 | $Fe_{78}$—$B_{10}$—$Si_{12}$ | 0.20 | 1.53 | Invention Example |
| 2 | $Fe_{80}$—$B_{10}$—$Si_{10}$ | 0.22 | 1.55 | Invention Example |
| 3 | $Fe_{82}$—$B_{10}$—$Si_{8}$ | 0.23 | 1.57 | Invention Example |
| 4 | $Fe_{83}$—$B_{10}$—$Si_{7}$ | 0.23 | 1.58 | Invention Example |
| 5 | $Fe_{80}$—$B_{8}$—$Si_{12}$ | 0.23 | 1.55 | Invention Example |
| 6 | $Fe_{79}$—$B_{15}$—$Si_{6}$ | 0.22 | 1.54 | Invention Example |
| 7 | $Fe_{80}$—$B_{7}$—$Si_{13}$ | 0.23 | 1.55 | Invention Example |
| 8 | $(Fe_{80}$—$B_{10}$—$Si_{10})_{99.8}$—$Cr_{0.2}$ | 0.16 | 1.54 | Invention Example |
| 9 | $(Fe_{80}$—$B_{10}$—$Si_{10})_{99}$—$Cr_{1}$ | 0.16 | 1.53 | Invention Example |
| 10 | $(Fe_{80}$—$B_{10}$—$Si_{10})_{99.8}$—$Mn_{0.2}$ | 0.16 | 1.54 | Invention Example |
| 11 | $(Fe_{80}$—$B_{10}$—$Si_{10})_{98}$—$Mn_{2}$ | 0.16 | 1.53 | Invention Example |
| 12 | $(Fe_{80}$—$B_{10}$—$Si_{10})_{98.5}$—$Cr_{1}$—$C_{0.5}$ | 0.16 | 1.52 | Invention Example |
| 13 | $(Fe_{80}$—$B_{10}$—$Si_{10})_{98.8}$—$Mn_{0.2}$—$P_{1}$ | 0.16 | 1.53 | Invention Example |
| 14 | $Fe_{77}$—$B_{10}$—$Si_{13}$ | 0.32 | 1.50 | Comparative Example |
| 15 | $Fe_{84}$—$B_{10}$—$Si_{6}$ | 0.40 | 1.50 | Comparative Example |
| 16 | $Fe_{81}$—$B_{6}$—$Si_{13}$ | 0.45 | 1.49 | Comparative Example |
| 17 | $Fe_{78}$—$B_{16}$—$Si_{6}$ | 0.43 | 1.49 | Comparative Example |
| 18 | $(Fe_{80}$—$B_{10}$—$Si_{10})_{98.5}$—$Cr_{1.5}$ | 0.45 | 1.46 | Comparative Example |
| 19 | $(Fe_{80}$—$B_{10}$—$Si_{10})_{98}$—$Mn_{2.5}$ | 0.43 | 1.47 | Comparative Example |

INDUSTRIAL APPLICABILITY

The technique of the invention can also be applied to an iron core of a motor, a reactor or the like other than the transformer.

REFERENCE SIGNS LIST

1: cooling roll
2: molten alloy vessel
3: molten alloy
4: nozzle for injecting molten alloy
5: nozzle for adjusting atmosphere of casting
6: air slit nozzle
S: amorphous alloy thin strip

The invention claimed is:

1. An amorphous alloy thin strip having a chemical composition represented by a chemical formula of $Fe_xB_ySi_z$ (x: 78-83 at %, y: 8-15 at % and z: 6-13 at %), wherein a generation density of air pockets on a face contacting with a cooling roll is not more than 8 pockets per 1 mm$^2$ and an arithmetic mean height Sa on portions other than the air pockets is not more than 0.2 μm, the amorphous alloy thin strip manufactured using a cooling roll of Si-containing copper alloy, wherein an Si content of the Si-containing copper alloy is 0.2 mass % or more.

2. The amorphous alloy thin strip according to claim 1, wherein one or two selected from Cr: 0.2-1 at % and Mn: 0.2-2 at % is included in addition to the above chemical composition.

3. The amorphous alloy thin strip according to claim 1, wherein one or two selected from C: 0.2-2 at % and P: 0.2-2 at % is included in addition to the above chemical composition.

4. The amorphous alloy thin strip according to claim 2, wherein one or two selected from C: 0.2-2 at % and P: 0.2-2 at % is included in addition to the above chemical composition.

* * * * *